US006840324B2

(12) United States Patent
Pettigrew

(10) Patent No.: US 6,840,324 B2
(45) Date of Patent: Jan. 11, 2005

(54) SYSTEM FOR, AND A METHOD OF PUMPING FLUIDS FROM A WELL

(76) Inventor: Dana Robert Pettigrew, 100 Eldorado Close N.E., Calgary Alberta (CA), T1Y 6T3

( * ) Notice: Subject to any disclaimer, the term of this patent is extended or adjusted under 35 U.S.C. 154(b) by 130 days.

(21) Appl. No.: 10/025,451

(22) Filed: Dec. 26, 2001

(65) Prior Publication Data

US 2003/0116323 A1 Jun. 26, 2003

(51) Int. Cl.[7] ..... E21B 43/00

(52) U.S. Cl. ..... 166/369; 166/66.4; 166/68; 166/105; 417/423.5

(58) Field of Search ..... 166/68, 105, 66.4, 166/369; 417/423.5, 423.3

(56) References Cited

U.S. PATENT DOCUMENTS 4,548,263 A * 10/1985 Woods ..... 166/105
5,320,182 A * 6/1994 Mendez ..... 166/387
6,092,600 A * 7/2000 McKinzie et al. ..... 166/266
6,206,093 B1 * 3/2001 Lee et al. ..... 166/60
6,454,010 B1 * 9/2002 Thomas et al. ..... 166/369
2002/0066568 A1 * 6/2002 Buchanan et al. ..... 166/313

* cited by examiner

*Primary Examiner*—Hoang Dang

(57) ABSTRACT

A system for pumping fluid from a well has a submersible pump introducible into a well for pumping fluid from the well to ground, submersible motor introducible into the well and connected to the submersible pump for driving the submersible pump, the motor including at least one upper tandem motor mechanically connectable to another motor and electrically connectable to a power source, and at least one additional upper tandem motor, the additional upper tandem motor being mechanically connected with the first mentioned upper tandem motor so as to drive the submersible pump with a mechanical power derived from the first mentioned upper tandem motor and the additional upper tandem motor, and a power supply which independently supplies electrical power to the upper tandem motors.

21 Claims, 6 Drawing Sheets

SYSTEM FOR, AND A METHOD OF PUMPING FLUIDS FROM A WELL

BACKGROUND OF THE INVENTION

The present invention relates to a system for and a method of pumping fluids from a well.

It is known in the field of pumping fluids from deep wells to use submersible pumps which are driven by submersible pump motors. The pump motors are frequently of three stages including an upper tandem motor, a center tandem motor and a lower tandem motor. They are controlled from the surface by a diesel engine, driving a generator which in turn drives a variable speed drive. In the known systems and methods of combining the tandem motors, horse power derived may be 500 hp. To double the power to 1000 hp and the subsequent volume of pumped fluids, it was necessary in the past to provide a 1000 hp tandem motor to be manufactured. It also required a larger diesel engine, generator and variable speed units, as well as a larger associated wiring due to high voltage and amperage at much higher costs.

SUMMARY OF THE INVENTION

Accordingly, it is an object of the present invention to provide a system for and a method of pumping fluids from a well, which avoids the disadvantages of the prior art.

In keeping with these objects and with others which will be come apparent hereinafter, one feature of the present invention resides, briefly stated, in a system for pumping fluids from a well to a ground, comprising a submersible pump introducible into a well for pumping fluids from the well to ground; submersible motor means introducible into the well and connected to said submersible pump for driving said submersible pump, said motor means including at least one upper tandem motor mechanically connectable to another motor and electrically connectable to a power source; and at least one additional upper tandem motor; said additional upper tandem motor being mechanically connected with said first mentioned upper tandem motor so as to drive said submersible pump with a mechanical power derived from said first mentioned upper tandem motor and said additional upper tandem motor; and power source means which supply electrical power to said upper tandem motors independently from one another.

It is also another feature of the present invention to provide a method of pumping fluids from a well to a ground, comprising the steps of introducing a submersible pump into a well for pumping fluids from the well to ground; introducing submersible motor means into the well and connecting it to said submersible pump for driving said submersible pump, using in said motor means at least one upper tandem motor mechanically connectable to another motor and electrically connectable to a power source; using in said motor means at least one additional upper tandem motor; mechanically connecting said additional upper tandem motor with said first mentioned upper tandem motor so as to drive said submersible pump with a mechanical power derived from said first mentioned upper tandem motor and said additional upper tandem motor; and supplying said upper tandem motors with electrical power from power source means independently from one another.

When the system is designed and a method is performed in accordance with the present invention, they are characterized by increased power and volume pumped and at the same time require only duplicate, existing, above ground equipment, rather than a larger equipment.

DESCRIPTION OF THE PREFERRED EMBODIMENTS

Figure 1:
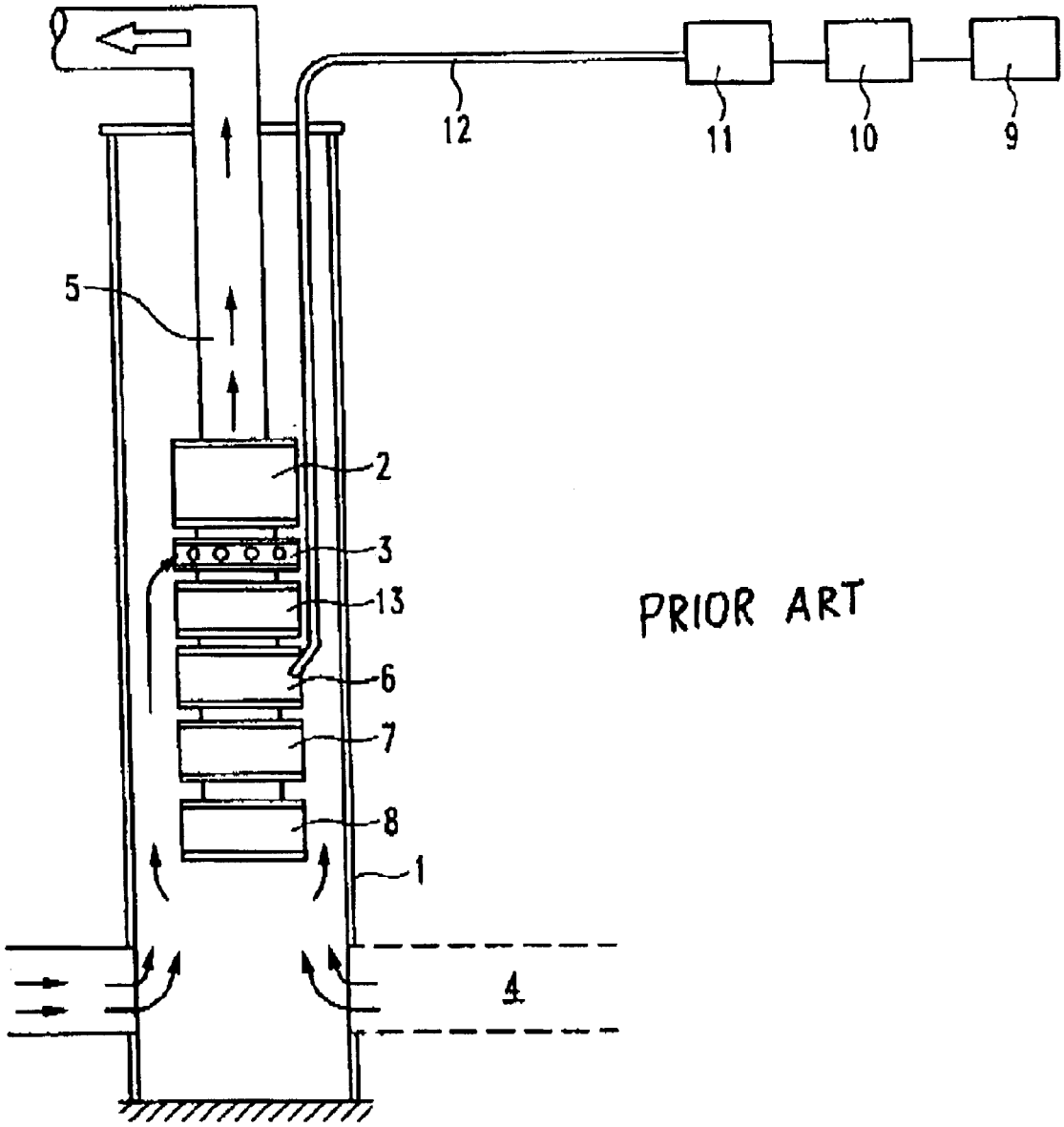
FIG. 1 is a view showing a system for and a method of pumping fluid from a well in accordance with the prior art.

FIG. 1 shows a conventional system for pumping petroleum from a well 1. The system includes a centrifugal pump 2 having an intake 3, which takes a fluid flow from a formation 4 and pumps it through a pump discharge 5 to a surface. The centrifugal pump is driven by a motor unit which includes an upper tandem motor 6, a center tandem motor 7 and a lower tandem motor 8. The motor unit can be provided with a motor protector 13. The tandem motors 6, 7 and 8 are mechanically connected with one another. For example, their shafts are mechanically coupled with one another. The tandem motors 6, 7 and 8 are also electrically connected with one another in series. In other words, their electrical systems are connected with one another as known in the art and not shown in the drawings.

An electrical power supply to the motor unit is performed from a single power source which can include a diesel engine identified with reference numeral 9, a generator 10 which is driven by the diesel engine, and a variable speed drive 11 which is driven by the generator. A single electrical supply line 12 extends from the thusly formed power source only to the upper tandem motor 6. Then the current is supplied in series to the center tandem motor 7 and the lower tandem motor 8 due to the electrical connection of the tandem motors 6, 7, and 8 with one another.

Figure 2:
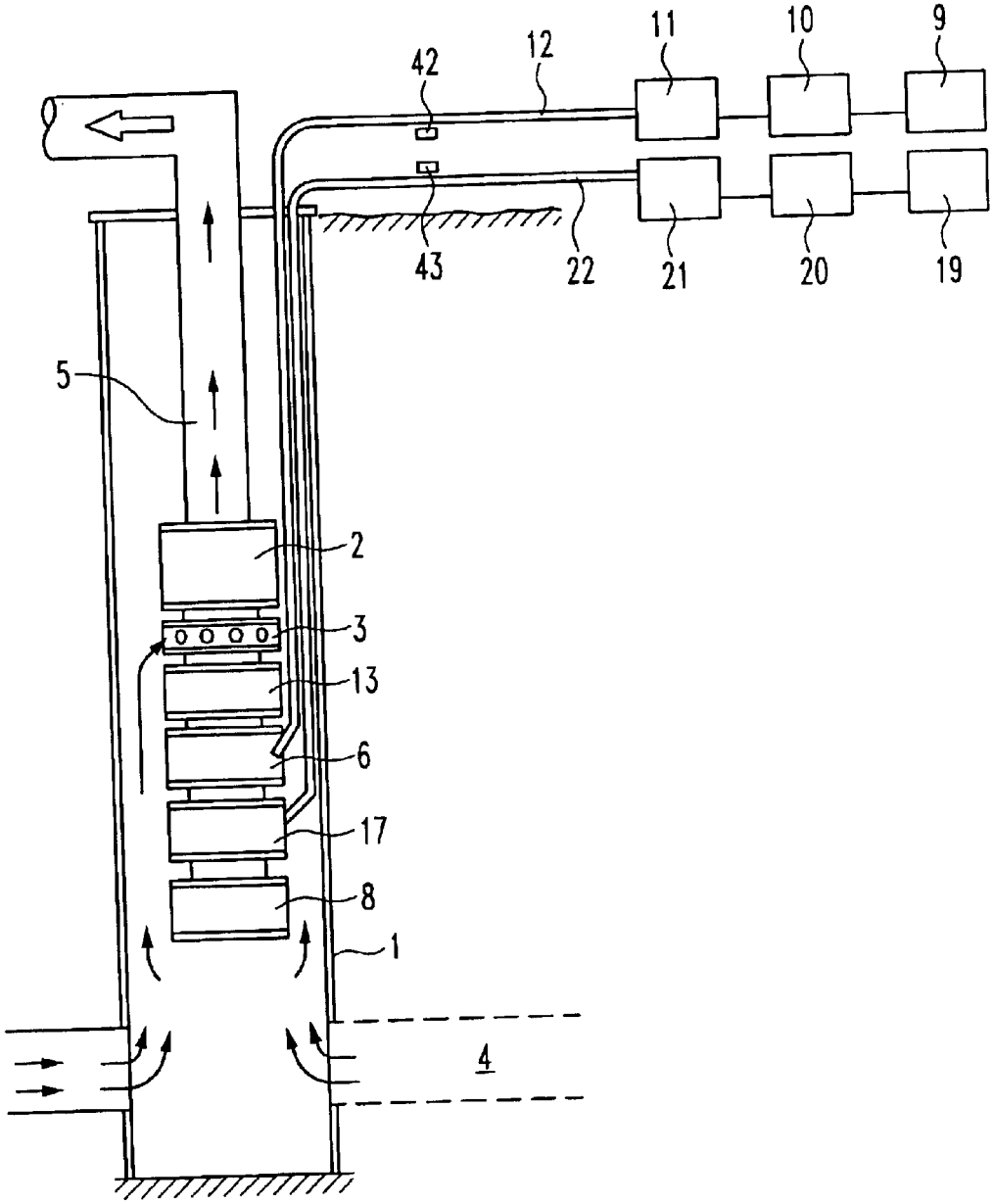
FIG. 2 is a view showing a system for and a method of pumping fluid from a well in accordance with one embodiment of the present invention.

FIG. 2 shows a system for pumping fluid from a well 1 in accordance with the present invention. The parts of the inventive system which are identical with the parts of the system of FIG. 1 are identified with the same reference numerals. The inventive system also includes a centrifugal pump 2 which through its intake 3 takes fluid flowing from the formation 4 and discharge it through the pump discharge 5 to the ground. The system also includes the upper tandem motor 6 which is supplied with lain power from the diesel engine 9 through the generator 10 and the variable speed drive 11 and through the electrical line 12. In the inventive system instead of the conventional center tandem motor 7 which is electrically and mechanically connected to the upper tandem motor 6, another upper tandem motor 17 is provided. The term "upper tandem motor" is utilized here to define a tandem motor which is not only mechanically connected to another motor, but also is separately connected to a power source to be separately supplied with electric power.

As can be seen from the drawings, the second upper tandem motor is supplied with power from a power supply unit including for example a diesel motor 19, a generator 20 which is driven by the diesel motor 19, a variable speed drive 21 which is driven by the generator 20, and an electrical supply line 22 extending from the variable speed drive 21 to the second upper tandem motor 17. The upper tandem motors 6 and 17 are connected with one another only mechanically, for example by coupling of their shafts with one another. However, they are supplied with power from independent power sources 9, 10, 11, and 12 and 19, 20, 21, and 22, which are independent from one another and are synchronized or unsynchronized with respect to their electrical parameters. The upper tandem motors 6 and 17 together form a so-called tandem/upper tandem motor. The system also can include other conventional tandem motors.

Figure 3A:
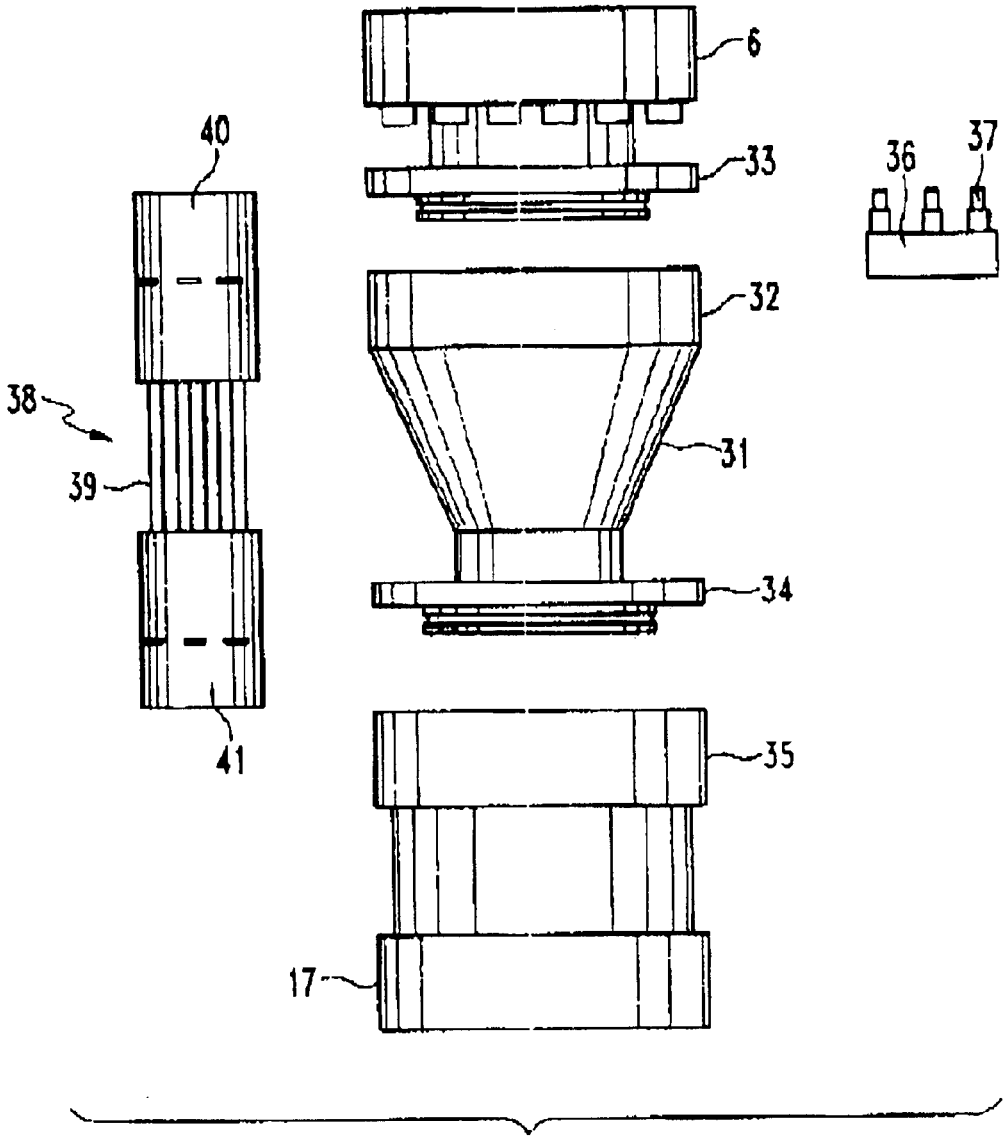
FIG. 3*a* is a view showing details of the system and method of FIG. 2, on an enlarged view.
Figure 3B:
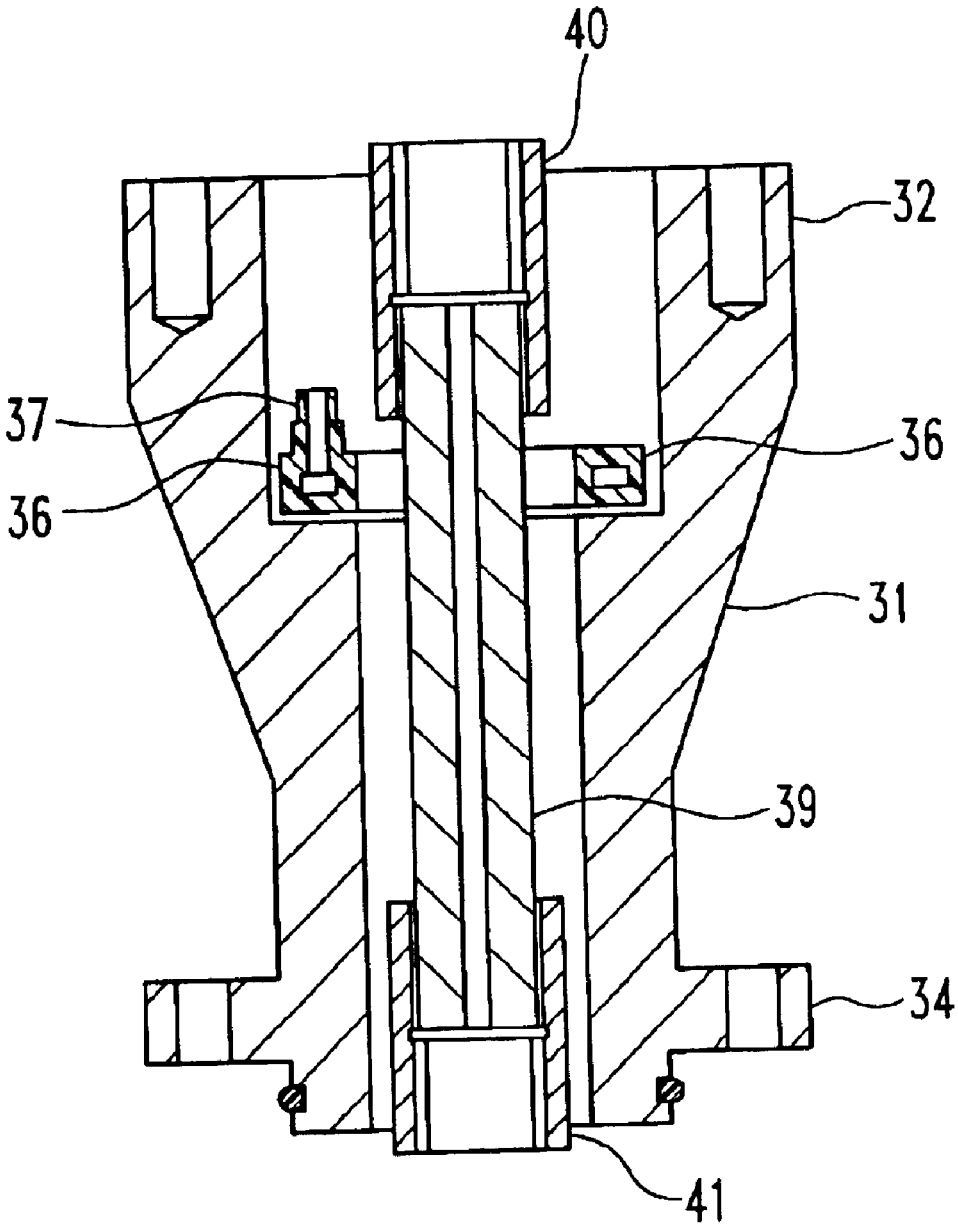
FIG. 3*b* is a sectional view of the inventive system and method.
Figure 4A:
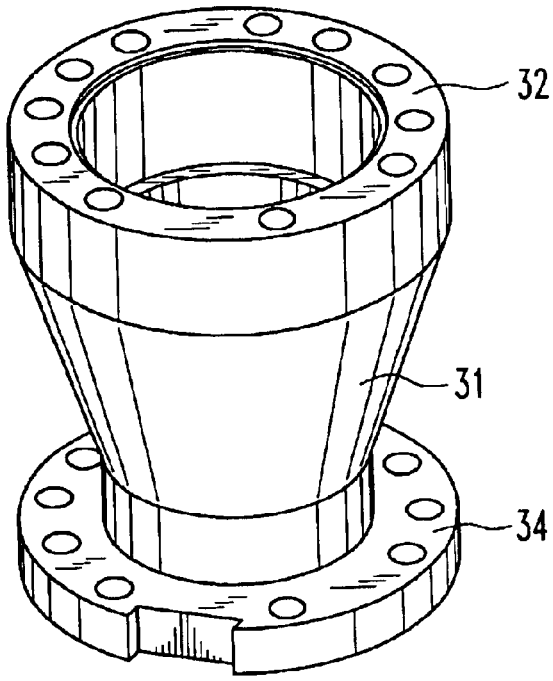
FIGS. 4 and 4*a* are views showing an adaptor and a shorting ring of the inventive system and method, in a perspective view.
Figure 4:
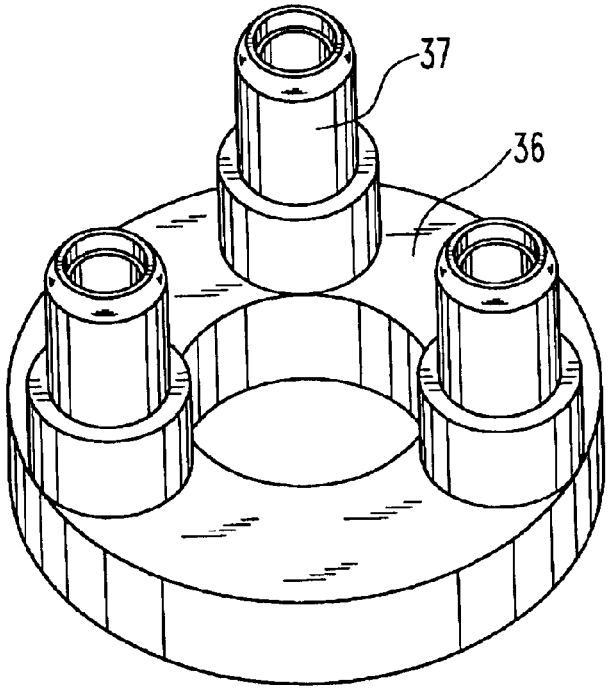

FIGS. 3*a*, 3*b* and 4 show some details of connection of the upper tandem motors 6 and 17. In order to connect the upper tandem motors with one another, an adaptor 31 is provided. The adaptor 31 has an upper flange 32 with a plurality of holes into which not shown bolts extending through corresponding holes in a lower flange 33 of the upper tandem motor 6 can extend so as to connect the upper flange 32 of the adaptor 31 to the lower flange 33 of the upper tandem motor 6. The adaptor 31 has a lower flange 34 which is also provided with a plurality of holes into which bolts extending through corresponding holes in lower flange 34 of the adaptor 31 so as to connect the upper flange 35 of the upper tandem motor 17 to the lower flange 34 of the adaptor 31. A shorting ring 36 provided with a plurality of hollow projections 37 can be arranged between the upper flange 32 of the adaptor 31 and the lower flange 33 of the upper tandem motor 6. The hollow projections 37 serve for connection of electrical cables from the tandem motor 6 as a common termination point as known in the art.

The system further has a connecting element 38 for mechanically connecting shafts of the upper tandem motor 6 and 17 with one another. The connecting element 38 includes a shaft portion 39 provided with an upper coupling 40 which is connectable to the shaft of the upper tandem motor 6 and a lower coupling 41 which is connectable with the shaft of the upper tandem motor 17. When the connecting element 38 is installed in the system, the shafts of the upper tandem motor 6 and 17 are mechanically connected with one another.

The system further has a switch 42 for turning on and off a power supply from the power source 9, 10, 11, and 12, to the upper tandem motor 6, and a switch 43 for turning on and off a power supply from the power source 19, 20, 21, and 22 to the upper tandem motor 17. The switches 42 and 43 are connected with one another so that they operate jointly, in other words for simultaneously turning on and off a power supply to the upper tandem motor 6 and the upper tandem motor 17.

While FIGS. 3 and 4 show connecting means including an adaptor, it is to be understood that other connecting means can be provided as well. For example the corresponding parts of the upper tandem motors can be formed so that they can be directly connected with one another without intermediate elements. It is also to be understood that the motor unit of the present invention can be provided with a greater number of tandem motors. It is believed that the operation of the inventive system is understood. When the tandem motors are supplied with electrical power from the power sources, they jointly drive the centrifugal pumps which pumps fluid from the well to the ground.

Figure 5:
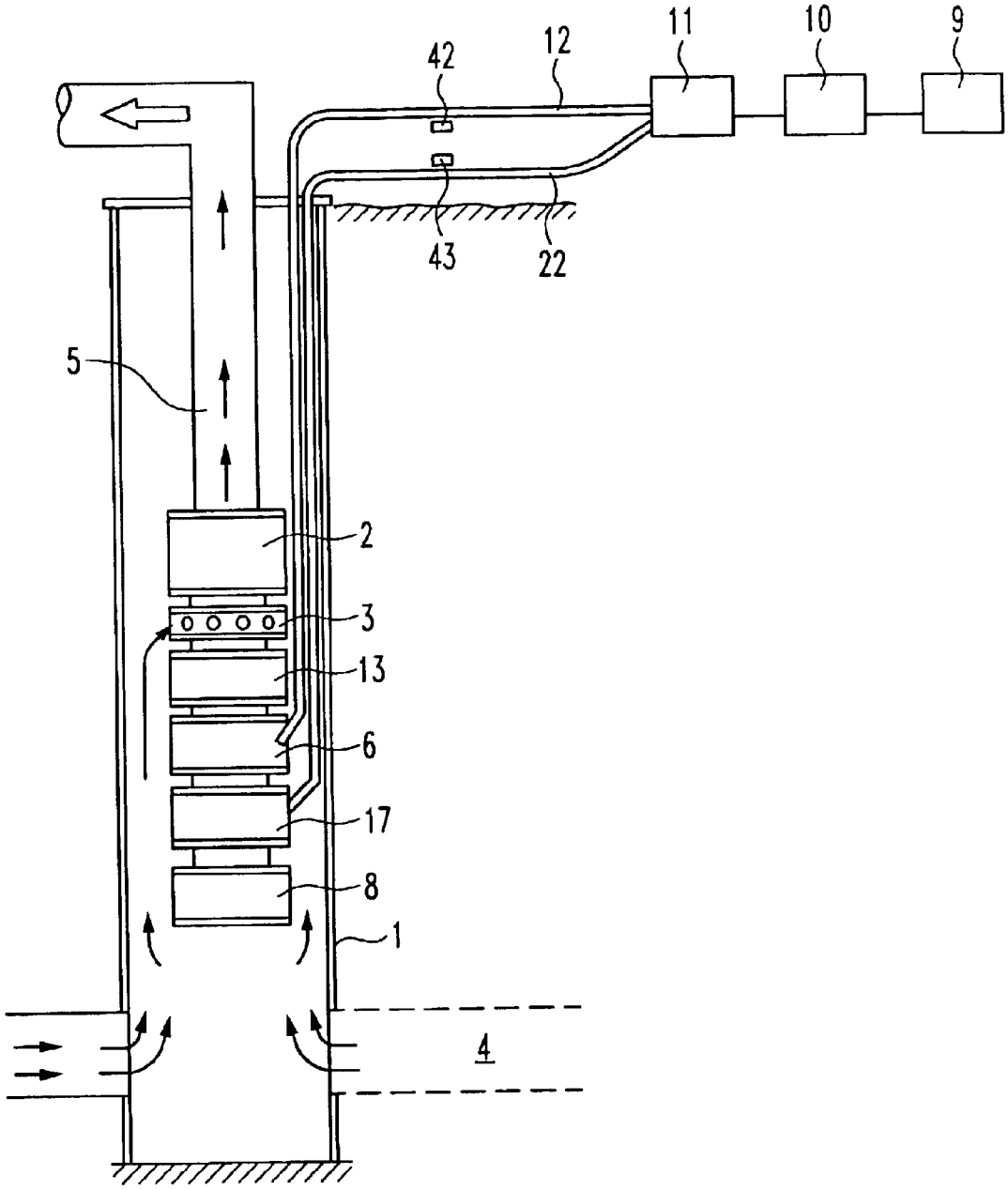
FIG. 5 shows a further modification of the present invention.

FIG. 5 shows another embodiment of the present invention. Here both upper tandem motors 6 and 17 are supplied with electric power from the same power source 9, 10, and 11, but for example through separate electrical lines 12 and 22, thus separately receiving electrical power.

It will be understood that each of the elements described above, or two or more together, may also find a useful application in other types of constructions differing from the types described above.

While the invention has been illustrated and described as embodied in a system for, and a method of pumping fluid from a well, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A system for pumping fluid from a well, comprising a submersible pump introducible into a well for pumping petroleum from the well to ground; submersible motor means introducible into the well and connected to said submersible pump for driving said submersible pump, said motor means including at least one upper tandem motor mechanically connectable to another motor and electrically connectable to a power source; and at least one additional upper tandem motor, said additional upper tandem motor being mechanically connected with said first mentioned upper tandem motor so as to drive said submersible pump with a mechanical power derived from said first mentioned upper tandem motor and said additional upper tandem motor, which independently supply electrical power to said upper tandem motors.

2. A system as defined in claim 1, wherein said electrical power source means include a single power source electrically connected to both said tandem motors.

3. A system us defined in claim 1, wherein said electrical power source mains include at least two power sources which are selected from the group consisting of synchronized power sources and unsynchronized power sources and separately supply electrical power to said upper tandem motors.

4. A system as defined in claim 3, wherein each of said power sources include an engine, a generator with is driven by an engine, and a line supplying electrical current from said generator to a corresponding one of said upper tandem motors.

5. A system us defined in claim 1; and further comprising means for mechanically connecting said upper tandem motors with one another.

6. A system as defined in claim 5, wherein said connecting mains include an adaptor provided between said upper tandem motors and having corresponding upper and lower parts each connected to a respective one of said upper tandem motors.

7. A system as defined in claim 6, wherein said parts are formed as flanges provided with a plurality of hole for passing fasteners there through.

8. A system us defined in claim 6; and further comprising a connecting element for connecting shafts of said upper tandem motors with one another, said connecting element including a shaft portion with an upper coupling connected to a shaft of one of said upper tandem motors and a lower coupling connected to a shaft of the other of said upper tandem motors, said connecting element extending through an interior of said adaptor.

9. A system a defined in claim 3; and further comprising means for turning on and off electrical power supply from said power sources to said upper tandem motors, said turning means for being operative for turning on and off electrical power supply from said power sources to said upper tandem motors simultaneously.

10. A system as defined in claim 9, wherein said means for turning on and off include switches means which are operative for turning on and off the electrical current supply from said power sources to said upper tandem motors simultaneously.

11. A method of pumping fluid from a well to a ground, comprising introducing of a submersible pump into a well for pumping fluid from the well to ground; introducing submersible motor means into the well and connecting to said submersible pump for driving said submersible pump, providing in said motor means at least one upper tandem motor mechanically connectable to another motor and electrically connectable to a power source; mechanically connecting said additional upper tandem motor with said first mentioned upper tandem motor so as to drive said submersible pump with a mechanical power derived from maid first mentioned upper tandem motor and said additional upper tandem motor, and connecting said upper tandem motors with electrical power source means.

12. A method as defined in claim 11; and further comprising using a single power source for both upper tandem motors as the electrical power source means.

13. A method as defined in claim 11; and further comprising using two separate power sources for the upper tandem motors selected from the group consisting of electrically synchronized and electrically unsynchronized power sources as the electrical power source means.

14. A method as defined in claim 13; and further comprising including in each of sold power sources include an engine, a generator which is driven by an engine, and a line supplying electrical current from said generator to a corresponding one of said upper tandem motors.

15. A method as defined in claim 11; and further corn priming mechanically connecting said upper tandem motors with said additional tandem motor by connecting means while retaining said upper tandem motors not electrically connected with one another.

16. A method as defined in claim 15; and further comprising including in said connecting means an adaptor provided between said upper tandem motors and having corresponding upper and lower parts such connected to a respective one of said upper tandem motors.

17. A method as defined in claim 16; and further comprising forming said parts as flanges provided with a plurality of holes for passing fasteners there through.

18. A method as defined in claim 17; and further comprising for connecting shafts of said upper tandem motors with one another by a connecting element including a shaft portion with an upper coupling connected to a shaft of one of maid upper tandem motors and a lower coupling connected to a shaft of the other of said upper tandem motor, so that aaid connecting element extending through an interior of said adaptor.

19. A method as defined in claim 11; and further comprising turning on and off an electrical power supply from said power sources to said upper tandem motors by turning means operative for turning on and off an electrical power supply from said power sources to said upper tandem motors simultaneously.

20. A method as defined in claim 19; and further comprising using in said turning means switches which are operative for turning on and off the electrical currant supply from said power sources to said upper tandem motors simultaneously.

21. A motor unit for driving a submersible pump for pumping fluid from a well, comprising a first upper tandem motor which is mechanically connectable to another motor and electrically connectable to a power source; at least one additional upper tandem motor which is mechanically connectable to another motor and electrically connectable to another power source; connecting means for mechanically connecting said at least two tandem motors with one another without electrically connecting said at least two tandem motors with one another, and means for connecting said at least two tandem motors with power supply means for separately receiving electrical power, so that said at least two upper tandem motors mechanically connected to one another and are supplied with electrical power independently form one another, and one of said upper tandem motors is connectable to a centrifugal pump to drive the latter by mechanical power of said at least two upper tandem motors.

* * * * *